US008720689B2

(12) United States Patent
Kirkland et al.

(10) Patent No.: US 8,720,689 B2
(45) Date of Patent: May 13, 2014

(54) MULTI-TIERED CUPCAKE CONTAINER

(75) Inventors: H. Bernard Kirkland, Lindenhurst, IL (US); John Kerry Hobbs, McDonough, GA (US)

(73) Assignee: Pactiv LLC, Lake Forest, IL (US)

( * ) Notice: Subject to any disclaimer, the term of this patent is extended or adjusted under 35 U.S.C. 154(b) by 140 days.

(21) Appl. No.: 13/156,143

(22) Filed: Jun. 8, 2011

(65) Prior Publication Data

US 2012/0234717 A1 Sep. 20, 2012

Related U.S. Application Data

(63) Continuation-in-part of application No. 29/387,753, filed on Mar. 17, 2011, now Pat. No. Des. 655,567.

(51) Int. Cl.
*B65D 73/00* (2006.01)

(52) U.S. Cl.
USPC ..... 206/551; 206/488; 206/564

(58) Field of Classification Search
USPC ..... 206/551, 486, 488, 740, 557, 562–564
See application file for complete search history.

(56) References Cited

U.S. PATENT DOCUMENTS

| | | | | |
|---|---|---|---|---|
| 148,735 | A * | 3/1874 | Milliken | 206/18 |
| 697,247 | A * | 4/1902 | Harris | 206/562 |
| D51,881 | S | 3/1918 | Evans | |
| 1,399,449 | A | 12/1921 | Threthewey | |
| 1,912,329 | A | 5/1933 | Wassell | |
| 2,446,629 | A | 8/1948 | Brown | |
| 3,034,496 | A | 5/1962 | Greenwald | |
| 4,011,954 | A * | 3/1977 | Galli | 211/14 |
| 4,351,313 | A | 9/1982 | Kern | |
| 4,359,159 | A | 11/1982 | Pollard | |
| 4,411,868 | A * | 10/1983 | Noack | 422/562 |
| 4,492,333 | A | 1/1985 | Roberts | |
| 4,573,586 | A * | 3/1986 | Helmer | 211/14 |
| 4,844,243 | A | 7/1989 | Stiles | |
| 4,848,543 | A | 7/1989 | Doboze | |
| 5,082,677 | A | 1/1992 | Bear | |
| 5,271,496 | A * | 12/1993 | Cain | 206/217 |
| D354,421 | S * | 1/1995 | Helmer | D7/669 |

(Continued)

FOREIGN PATENT DOCUMENTS

WO WO98/52835 11/1998

OTHER PUBLICATIONS

U.S. Appl. No. 29/387,753, Dec. 19, 2011 Notice of Allowance.
U.S. Appl. No. 29/387,753, filed Mar. 17, 2011.

*Primary Examiner* — J. Gregory Pickett
*Assistant Examiner* — Robert Poon
(74) *Attorney, Agent, or Firm* — Baker Botts L.L.P.

(57) ABSTRACT

Tray includes a first base portion having an upper surface defining a first tier and a second portion having an upper surface defining a second tier. The first tier and the second tier are separated by a height. The upper surface of the first portion and the upper surface of the second portion each have a plurality of spaced-apart wells defined therein. Each well is sized and shaped to receive a food item and has an upper edge with an engagement recess formed therein. The engagement recess is sized to allow a food item within the well to be gripped for removal. The tray can further include a trapping feature to secure a lid, and thus form a container.

24 Claims, 5 Drawing Sheets

(56) References Cited

U.S. PATENT DOCUMENTS

| | | | | |
|---|---|---|---|---|
| 5,413,801 | A | 5/1995 | McIlwain | |
| 5,676,252 | A | 10/1997 | Lillelund et al. | |
| D396,388 | S | 7/1998 | Mishan | |
| D401,734 | S * | 11/1998 | Monk | D99/25 |
| 5,912,033 | A | 6/1999 | Ferguson | |
| D459,988 | S | 7/2002 | Hogman | |
| D469,653 | S | 2/2003 | Cooper et al. | |
| 6,679,380 | B2 | 1/2004 | Brown | |
| D497,077 | S | 10/2004 | De Groote | |
| 6,896,140 | B1 | 5/2005 | Perry | |
| D511,652 | S | 11/2005 | Paplinski | |
| D515,363 | S * | 2/2006 | Driggers et al. | D7/610 |
| 7,021,465 | B1 * | 4/2006 | McGuigan | 206/457 |
| 7,128,000 | B2 | 10/2006 | Mummert | |
| D543,797 | S | 6/2007 | Kaposi | |
| D544,343 | S | 6/2007 | Liebe | |
| D574,663 | S | 8/2008 | Courington et al. | |
| D577,535 | S | 9/2008 | Courington et al. | |
| D601,860 | S | 10/2009 | Madagan | |
| D604,109 | S * | 11/2009 | Madagan | D7/610 |
| 2009/0191317 | A1 * | 7/2009 | Lin | 426/119 |
| 2010/0015310 | A1 | 1/2010 | Wallace | |
| 2010/0200583 | A1 * | 8/2010 | Curtin et al. | 220/4.27 |

* cited by examiner

MULTI-TIERED CUPCAKE CONTAINER

CROSS REFERENCE TO RELATED APPLICATIONS

This application is a Continuation-In-Part of U.S. Design application Ser. No. 29/387,753, filed on Mar. 17, 2011, the contents of which is expressly incorporated in its entirety herein by reference thereto.

BACKGROUND OF THE INVENTION

1. Field of the Invention

The present disclosed subject matter relates to a food packaging system of a disposable container and tray for packaging and displaying food items, such as cupcakes. Particularly, the present disclosed subject matter is directed to a container for holding food items, wherein the container has a tray having a plurality of tiers for storing and displaying food items at different heights.

2. Description of Related Art

A variety of containers are known for packaging of food products for secure shipping. Conventional food container designs include a tray having multiple wells to receive food products. Such conventional containers generally have been considered satisfactory for their intended purpose, however where the wells are closely spaced, it can be difficult for a consumer to access an individual food item for removal by hand without destroying the food item or disrupting adjacent food items. Where the food items are individual-serving pastries, for instance cupcakes, consumers desire the ability access an individual cupcake without contaminating the frosting on top of adjacent cupcakes and without damaging the frosting head of the selected cupcake in the removal process.

Some examples of prior art designs directed to containers having tiered trays can be found in U.S. Pat. Nos. 5,413,801 and 7,128,000. Other prior art designs directed to food trays with a plurality of individual wells can be found in U.S. Pat. No. 4,844,243 and U.S. Design Pat. No. D601,860. As evident from the related art, conventional configurations do not provide adequate access to individual food items, often require unnecessarily complex and excessively wasteful designs, or are not robust enough to provide the requisite durability of a packaging container. There thus remains a need for an efficient and economic method and system for a multi-tiered food container that securely encloses and stores the food product, yet provides easy access to individual food items for removal.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a container comprising a tray including a first portion and a second portion. The first portion has an upper surface defining a first tier, and the second portion has an upper surface defining a second tier. The first tier and the second tier are separated by a height. The upper surface of the first portion and the upper surface of the second portion each have a plurality of spaced-apart wells defined therein. Each well is sized and shaped to receive a food item, and each well has an upper edge with an engagement recess formed therein. The engagement recess is sized to allow a food item within the well to be gripped for removal.

As embodied herein, the first tier can define a first horizontal plane, and the second tier can define a second horizontal plane. The first portion can be located proximate a center of the tray, and the second portion can surround the first portion. In this configuration, the first portion can have a generally circular shape, and the second portion can have a ring shape concentric with the first portion. The first tier can be above the second tier. The tray can include a sidewall extending between the first portion and the second portion, and the sidewall can be angled relative the first tier and the second tier. An interface between the sidewall and at least one of the first tier and the second tier can be radiused when viewed in cross-section.

In some embodiments, each well has a depth defined between the upper edge of the well and a bottom of the well, and the height between the first tier and the second tier is less than the depth of a well in the first portion. The height can be approximately one-half the depth. The wells of the first portion and the second portion can be similar in size and shape. Each well can have a frustoconical shape, and the wells of at least one of the first portion and the second portion can have a non-planar bottom. The wells of the first portion can be evenly spaced apart and aligned in a first pattern, and the wells of the second portion can be evenly spaced apart and aligned in a second pattern. The second pattern can be concentric with the first pattern, and the wells of the first pattern can be offset relative to the wells of the second pattern. At least one engagement recess can be formed as a notch in the upper edge of the well, and at least one engagement recess can be formed as a channel disposed between two adjacent wells.

In some embodiments, the tray can include additional tiers. For example, and as embodied herein, the tray includes a third portion having an upper surface defining a third tier with a plurality of spaced-apart wells defined therein. The third tier can define a third horizontal plane and can be concentric with the first and second tiers.

In some embodiments, the tray includes a trapping feature to secure a lid. The disclosed subject matter also includes a container comprising a lid configured to be secured to the trapping feature of the tray.

The disclosed subject matter also includes a method of forming a tray. Forming a tray includes providing a sheet of polymeric material, and forming the sheet of polymeric material into a tray having any of the features described herein above. The tray can be formed of a single sheet of polymeric material.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
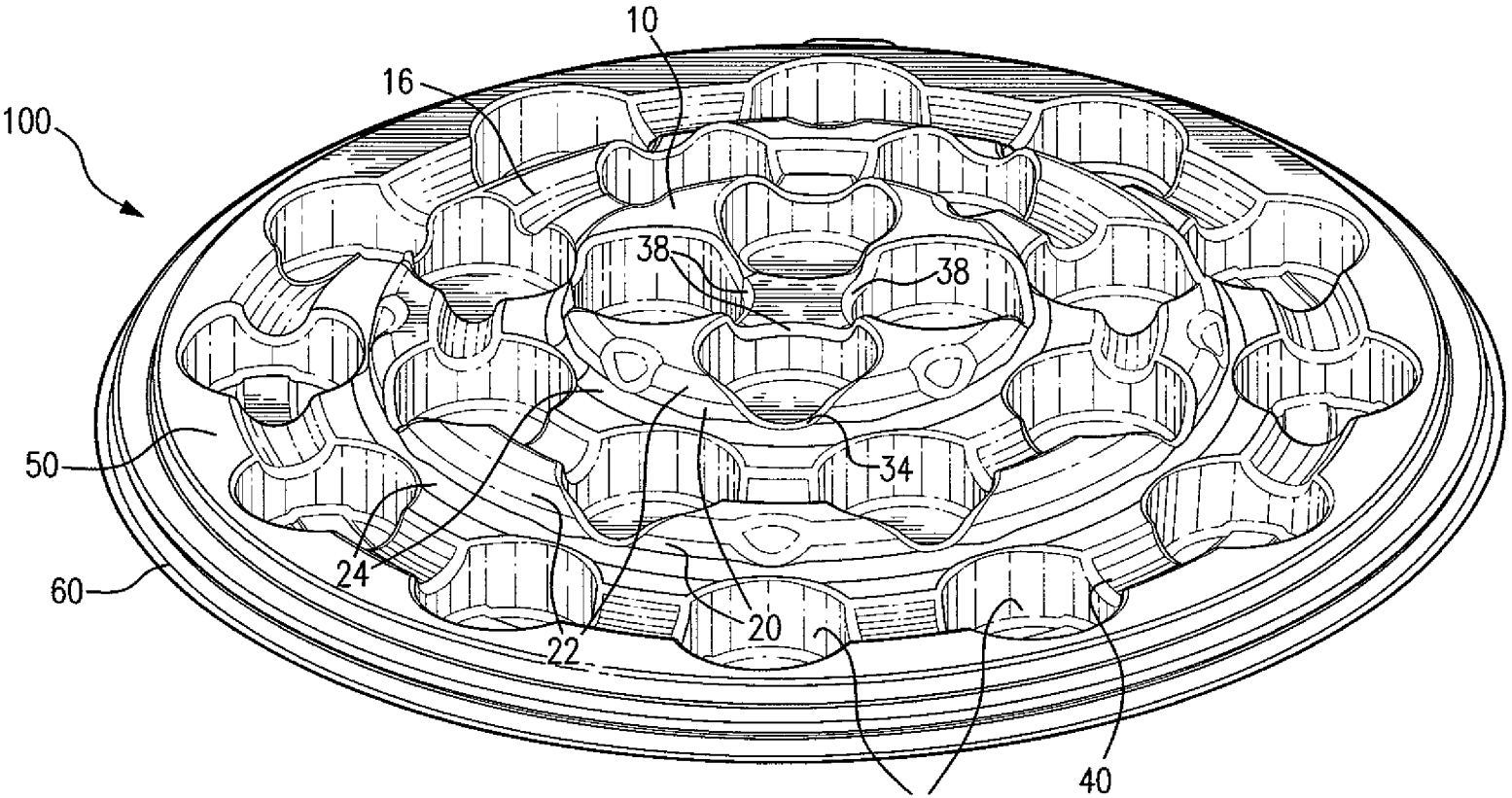
FIG. 1 is a perspective view of an exemplary embodiment of a tray in accordance with the disclosed subject matter.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein may be used for storage and display of food items and other perishable and nonperishable products. The disclosed subject matter is particularly suited for storage and display of food items, wherein the tray has a plurality of tiers for storing and displaying food items at different heights.

In accordance with the disclosed subject matter herein, the tray generally includes a first base portion having an upper surface defining a first tier and a second portion having an upper surface defining a second tier. The first tier and the second tier are separated by a height. The upper surface of the first portion and the upper surface of the second portion each have a plurality of spaced-apart wells defined therein. Each well is sized and shaped to receive a food item and has an upper edge with an engagement recess formed therein. The engagement recess is sized to allow a food item within the well to be gripped for removal. The tray can further include a trapping feature to secure a lid, and thus form a container.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-6. The container is suitable for use with a wide variety of perishable and nonperishable products, such as flowers, garden supplies, hardware components, electrical items, and craft items. However, the container disclosed herein is particularly suitable and beneficial for use with food items, wherein the multi-tiered container can be used for shipping, serving, storing, preparing and/or re-using such food items. Further, the container desirably, although not necessarily, can have insulating properties to assist in maintaining the temperature of food contained therein. For purpose of illustration, and not limitation, reference will made herein to a multi-tiered container intended to contain food items.

Figure 3:
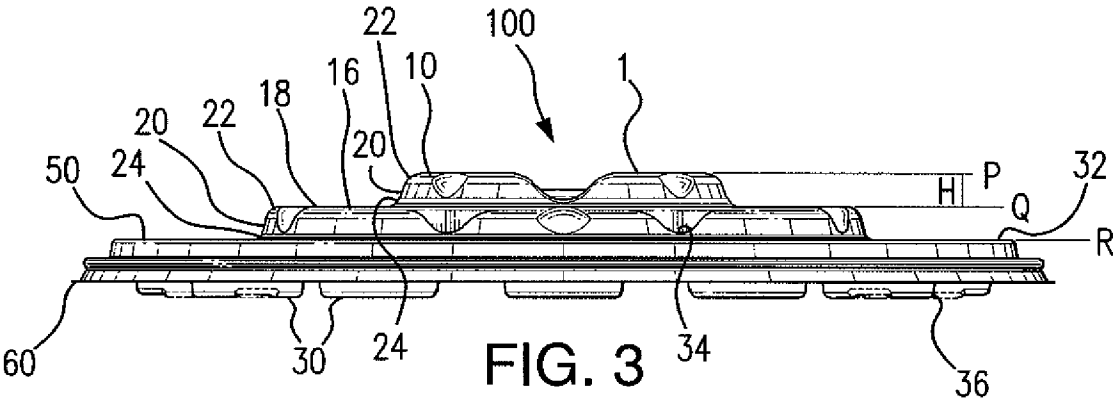
FIG. 3 is a left side view of the tray of FIG. 1.

In the exemplary embodiment shown in FIG. 1, the tray 100 generally includes a first portion 10 having an upper surface 12 defining a first tier P and a second portion 16 having an upper surface 18 defining a second tier Q. For purpose of illustration and not limitation, as best shown in FIG. 3, the first tier P can define a first horizontal plane, and the second tier Q can define a second horizontal plane. Alternatively, one or more of the tiers P, Q can have an angled configuration to define a portion of a frustoconical or pyramid shape, or the tiers P, Q can have a non-planar shape, such as a curved contour or any other suitable shape, as desired. If desired, the first portion 10 can be located proximate a center of the tray, and the second portion 16 can surround the first portion 10. In this configuration, as illustrated, the first portion 10 can have a generally circular shape, and the second portion 16 can have a ring shape concentric with the first portion 10. Alternatively, the first portion 10 and the second portion 16 can form a tray 100 with alternative shapes. For example, the tray 100 shape could be spiral, rectangular, square, triangular, or any geometrical shape. As a further alternative, the first portion 10 and the second portion 16 can be aligned generally parallel with each other or side-by-side, such as in a "stadium-seating" configuration.

The first tier P and the second tier Q are separated by a height H. In the exemplary embodiment, the first tier P is above the second tier Q. The first tier P and the second tier Q being separated by a height H creates a multi-tier or stepped configuration that allows food items, such as cupcakes, to be stored and displayed separated and staggered in height. For the purpose of illustration and not limitation, and with reference to a configuration for storing cupcakes, the multi-tier or stepped configuration can provide easy access to individual cupcakes, reduced frosting contamination, and reduced damaging of the frosting head.

Figure 4:
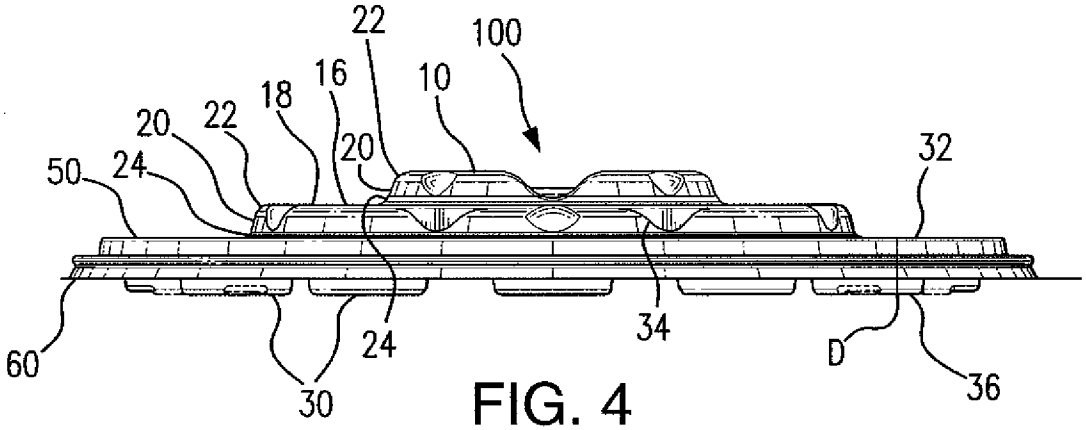
FIG. 4 is a right side view of the tray of FIG. 1.
Figure 5:
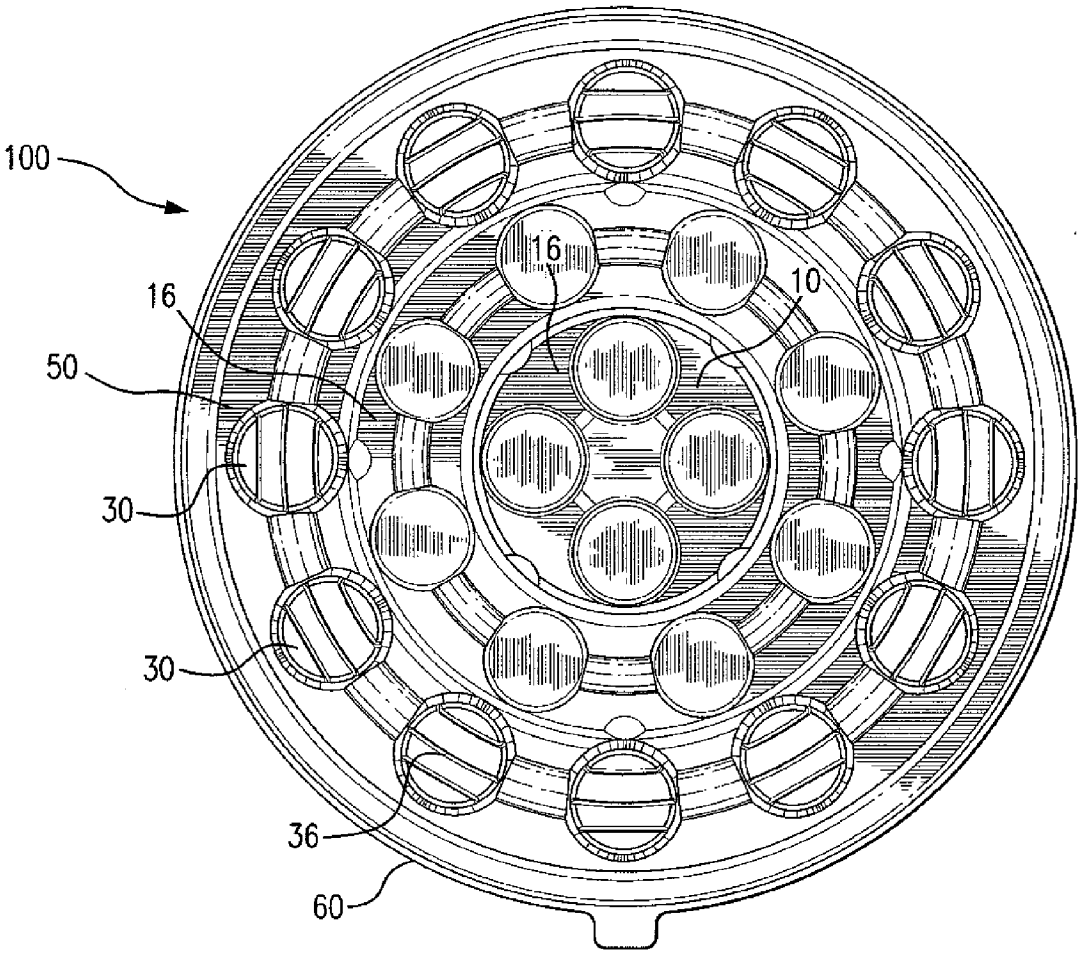
FIG. 5 is a bottom view of the tray of FIG. 1.

The tray 100 can further include a sidewall 20 extending between the first portion 10 and the second portion 16. It is contemplated that the sidewall 20 can project vertically upwardly from the second portion 16 to the first portion 10; however, the sidewall 20 can be angled relative the first tier P and the second tier Q. Additionally, an interface 22 is defined between the sidewall 20 and the first portion 10, and an interface 24 between the sidewall 20 and the second portion 16, as shown in FIGS. 3-4. As embodied herein, each interface 22, 24 can be angled, or alternatively, the interfaces 22, 24 can have a curvature, or radius, to blend the sidewall 20 with the first portion 10 and the second portion 16. The sidewall 20 can be a generally smooth wall or can be provided with formations, such as textured surface or aesthetic designs or patterns, as well as indicia if desired. Additionally, the sidewall can include reinforcing ribs or structures (not shown) for additional strength, if so desired.

Further in accordance with the invention, the upper surface of the first portion 10 and the upper surface of the second portion 16 each has a plurality of spaced-apart wells 30 defined therein. Each well 30 is sized and shaped to receive a food item and has an upper edge 32 with an engagement recess 34 formed therein. The engagement recesses 34 are sized to allow a food item within the well 30 to be gripped for removal. For purpose of illustration and not limitation, FIGS. 1-5 depict wells 30 configured to receive cupcakes, muffins, and the like.

To accommodate a food item, each well 30 has a depth D defined between the upper edge 32 of the well 30 and a bottom 36 of the well 30. To produce a multi-tier configuration of the disclosed subject matter, the height H between the first tier P and the second tier Q can be less than the depth D. In an exemplary embodiment, the height H can be approximately one-half the depth D. It is contemplated that the wells 30 of the first portion 10 and wells 30 of the second portion 16 are similar in size and shape; however, the wells 30 could be provided with a variety of shapes to accommodate different-sized food items. For purpose of illustration and not limitation, each well 30 can have a frustoconical shape, so as to receive a cupcake, muffin, or the like. Alternatively, the wells 30 can have a rectangular shape, or any other suitable shape, for holding any size or shape of food item, such as an éclair, donut, or other individually-sized food items.

The wells 30 of the first portion 10 and/or the wells 30 of the second portion 16 can have non-planar bottoms 36. The non-planar shape of the bottoms 36 can add strength to the tray to resist deformation. Further, the non-planar well bottoms 36 can extend below the other portions of the tray 100 to provide a bottom surface for storing and stacking on a support surface. In this manner, when a tray 100 is placed on a support surface, the non-planar bottoms 36 can provide a separation between the outer peripheral edge of the tray 100 and the support surface to allow a user to more easily grasp and lift the edge of the tray 100. Additionally, when a tray 100 is aligned vertically with and stacked on top of a similarly configured tray 100, the non-planar bottoms 36 can provide a separation between the trays 100 to allow a user to more easily grasp and separate an individual tray 100 from a stack of trays 100. The non-planar bottom 36 of the wells 30 can also provide an angled or non-planar support surface for a food item in the wells 30 to aid in lifting food items away from the bottom of the wells 30.

Figure 2:
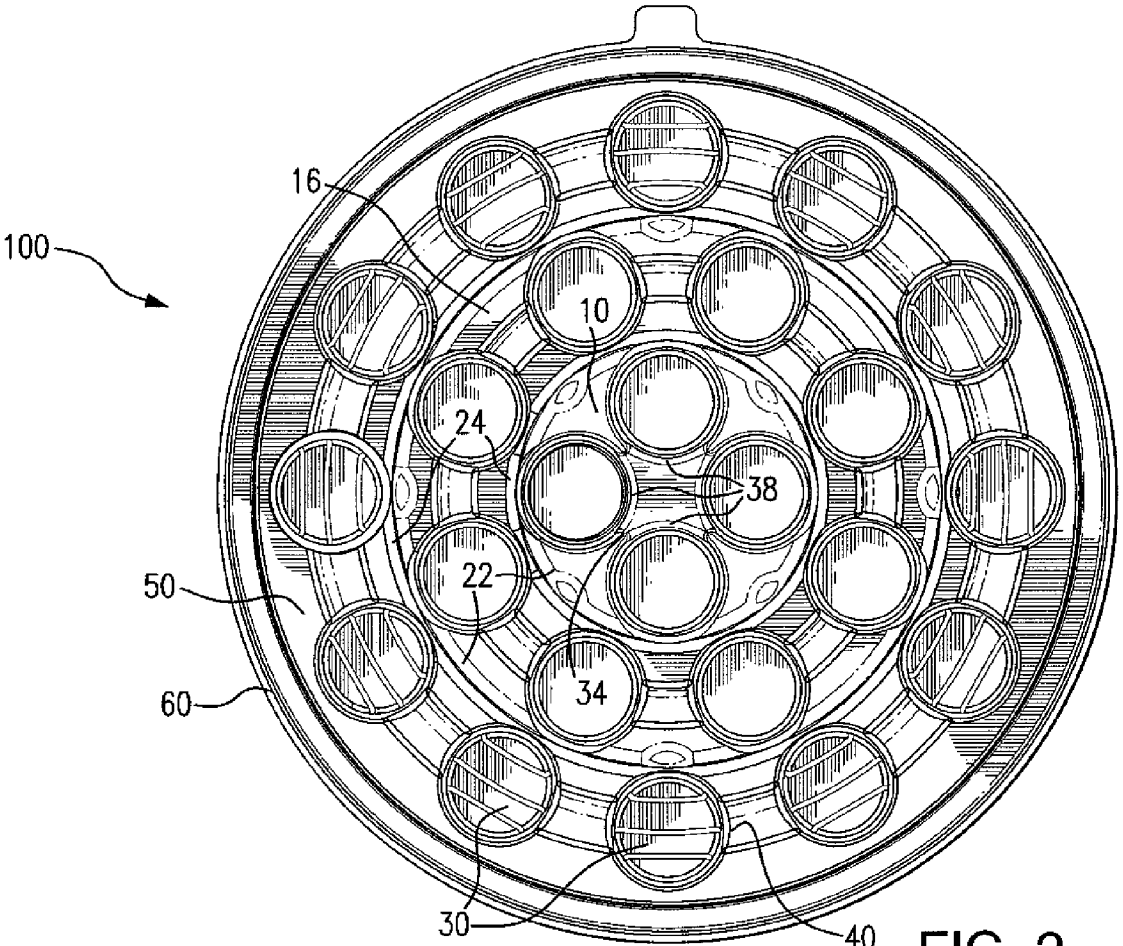
FIG. 2 is a top view of the tray of FIG. 1.

For purpose of illustration and not limitation, and with reference to the representative embodiment of FIGS. 1-2, the wells 30 of the first portion 10 can be evenly spaced apart and aligned in a first pattern. Similarly, the wells 30 of the second portion 16 can be evenly spaced apart and aligned in a second pattern. The wells 30 of the second pattern can be concentric with the wells 30 first pattern. Additionally, the wells 30 of the first pattern can be offset relative to the wells of the second pattern. In this manner, the wells 30 can be separated and staggered, which allows a user easy access to individual food items for removal. Alternatively, the wells 30 of the first pattern can be placed in-line with the wells 30 of the second pattern, and/or the wells 30 can be closely-spaced to allow more wells 30, and likewise more food items, to be placed in the same sized tray 100.

In accordance with another aspect of the disclosed subject matter, an engagement recess 34 can be formed as a notch 38 in the upper edge 32 of a well. Additionally or alternatively, an engagement recess 34 can be formed as a channel 40 disposed between two adjacent wells 30. The shape of the channel 40, in addition to providing a shape to allow a food item within a well 30 to be gripped, can also provide additional strength for the tray 100. As a further alternative, the engagement recess 34 can be formed as an indentation, or any other discontinuity in the shape of the well 30 that can provide a spacing between the food item and the well 30 to allow a user to grip a food item for removal from the well 30.

In accordance with the disclosed subject matter, additional tiers can be provided, with each tier separated from an adjacent tier by a height. For purpose of illustration and not limitation, and with reference to the representative embodiment of FIGS. 1-5, the tray 100 further includes a third portion 50 having an upper surface defining a third tier R with a plurality of spaced-apart wells 30 defined therein. The third portion 50 can include any of the features described herein with respect to the first portion 10 and the second portion 16, including but not limited to, its size, shape, position relative to the other portions, and the pattern of wells 30. For purpose of illustration and not limitation, as best shown in FIG. 3, the third tier R can define a third horizontal plane. Although a tray 100 having three portions 10, 16, 50 defining three tiers P, Q, R is shown in FIGS. 1-5, a tray 100 according to the disclosed subject matter is not limited to any number of portions, and can contain two, three, or more portions having various features described herein.

Figure 6:
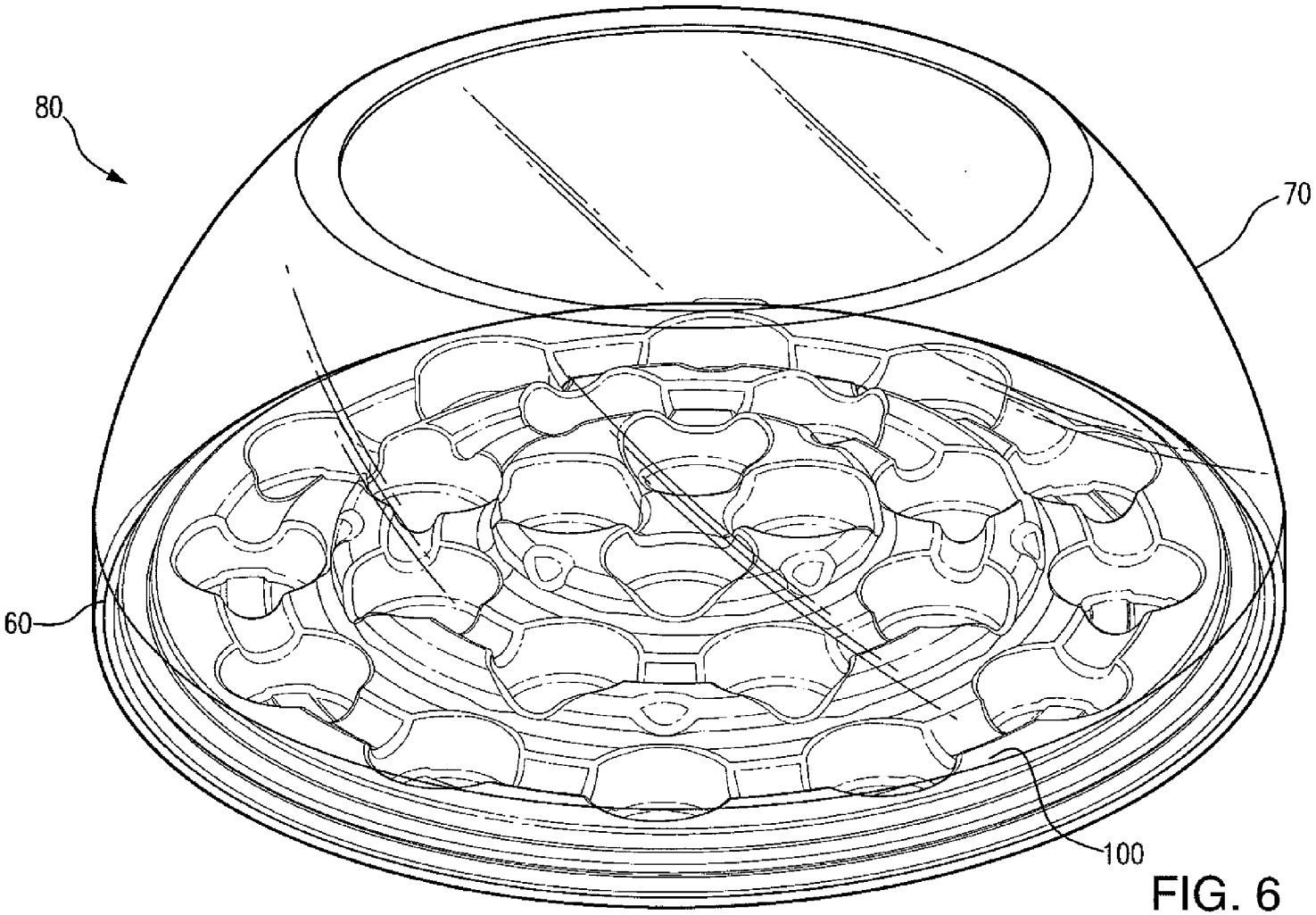
FIG. 6 is a perspective view of the tray of FIG. 1, shown with a lid in a closed configuration.

A tray 100 can have a trapping feature 60 to secure a lid 70 (shown in FIG. 6). The trapping feature 60 can be formed integrally with any suitable portion 10, 16, 50 of the tray 100, such as the outermost third portion 50 as shown in FIG. 2. The trapping feature 60 can be any suitable mechanism for securing a lid 70, for example but not limited to, an interlocking lip with underlying recess or other snap-fit connector. An alternative example of a pastry container with a lid and tray having trapping features is shown and described in U.S. patent application Ser. No. 11/998,582, which is incorporated by reference herein in its entirety. The lid 70 or the tray 100 can have a chamfered edge or the like to serve as a pilot to guide the lid 70 into a secured position with the tray 100. The chamfered edge can aid a user in securing and removing the lid 70 at an angle relative to the tray 100 so as to not interfere with food items in the tray 100, and thus reduce any damage to the food items, such as the frosting of a cupcake.

Further in accordance with the invention, as shown for example in FIG. 6, a container 80 can include a tray 100, having the features described herein, and a lid 70 configured to be secured to the trapping feature 60 of the tray 100. The lid 70 can be transparent to allow for display of the food items within the container 80, and the lid 70 can also allow for secure storage and shipping of the container 80 and food items. Additionally, the lid 70 can be configured for stacking of multiple containers 80 on top of each other, for example by having a top surface configured to receive a portion of a tray 100 located thereon. For purpose of illustration and not limitation, the lid 70 shown in FIG. 6 is dome shaped; however, it is contemplated that the lid 70 can be frustoconical, cylindrical, or any other suitable shape for securely covering the tray 100.

The tray and lid disclosed herein are preferably disposable, but it is contemplated that they may be reused at a future time. Also, the tray and lid can be constructed from materials suitable to be placed in a heating apparatus, such as a microwave, to heat the food and/or used for storage in the refrigerator or freezer. Additionally, the materials from which the tray and lid is made need not be the same throughout.

The tray and lid described herein can be manufactured from any suitable material, for example, expanded polystyrene foam, oriented polystyrene (OPS), polypropylene, mineral filled polypropylene, amorphous polyethylene terephthalate (APET), thermoplastics, and paper. It is to be understood that the foregoing list is not exhaustive, and that the containers can be made from other materials. In an exemplary embodiment, a tray 100 having the features described herein is formed from a single sheet of polymeric material. Forming a tray 100 can include providing a sheet of polymeric material, or other suitable material, and forming the material into a tray 100 having various features described herein. The tray 100, and lid 70 if provided, can be formed utilizing any type of stamping or molding process, or any other suitable process.

It is to be recognized that the dimensions and relative proportions of the tray portions and wells of the tray will vary according to the size and intended use of the tray and related contents. While a generally circular multi-tier tray 100 is illustrated in FIG. 1, one of ordinary skill will recognize that any suitable shape and size of tray 100 can be employed and the disclosed subject matter is not so limited. Other suitable shapes include spirals, rectangles, ovals, various polygons, etc.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

We claim:

1. A tray, comprising:

a first portion having a generally circular shape and an upper surface defining a first tier and a second portion having a ring shape concentric with the first portion and spaced outwardly from and surrounding the first portion and having an upper surface defining a second tier, the first tier and the second tier being separated by a height;

the upper surface of the first portion and the upper surface of the second portion each having a plurality of spaced-apart wells defined therein, each well having a bottom, the bottoms of the wells of the first tier disposed a distance upwardly from the bottoms of the wells of the second tier; and each well sized and shaped to receive a food item and having an upper edge with an engagement recess formed therein, the engagement recess being sized to allow a food item within the well to be gripped for removal;

wherein the tray is formed of a single sheet of material.

2. The tray of claim 1, wherein the first tier defines a first horizontal plane and the second tier defines a second horizontal plane.

3. The tray of claim 1, wherein the first portion is located proximate a center of the tray.

4. The tray of claim 1, wherein the first tier is above the second tier.

5. The tray of claim 4 further comprising a sidewall extending between the first portion and the second portion.

6. The tray of claim 5, wherein the sidewall is angled relative the first tier and the second tier.

7. The tray of claim 6, wherein an interface between the sidewall and at least one of the first tier and the second tier is radiused.

8. The tray of claim 4, wherein each well has a depth defined between the upper edge of the well and the bottom of the well, and further wherein the height between the first tier and the second tier is less than the depth of each well in the first portion.

9. The tray of claim 8, wherein the depth of the wells are similar and the height is approximately one-half the depth.

10. The tray of claim 1, wherein the wells of the first portion and of the second portion are similar in size and shape.

11. The tray of claim 1, wherein each well has a frustoconical shape.

12. The tray of claim 1, wherein the wells of at least one of the first portion and the second portion has a non-planar bottom.

13. The tray of claim 1, wherein the wells of the first portion are evenly spaced apart and aligned in a first pattern.

14. The tray of claim 13, wherein the wells of the second portion are evenly spaced apart and aligned in a second pattern.

15. The tray of claim 14, wherein the second pattern is concentric with the first pattern.

16. The tray of claim 14, wherein the wells of the first pattern are offset relative to the wells of the second pattern.

17. The tray of claim 1, wherein at least one engagement recess is formed as a notch in the upper edge of the well.

18. The tray of claim 1, wherein at least one engagement recess is formed as a channel disposed between two adjacent wells.

19. The tray of claim 1, further comprising a third portion having an upper surface defining a third tier with a plurality of spaced-apart wells defined therein.

20. The tray of claim 19, wherein the third tier defines a third horizontal plane.

21. The tray of claim 1, further comprising a trapping feature to secure a lid.

22. The tray of claim 1, wherein the single sheet comprises a polymeric material.

23. A container, comprising:

a tray, comprising:

a first portion having a general circular shape and an upper surface defining a first tier and a second portion having a ring shape concentric with the first portion and spaced outwardly from the first portion and having an upper surface defining a second tier, the first tier disposed upwardly from the second tier by a height;

the upper surface of the first portion and the upper surface of the second portion each having a plurality of spaced-apart wells defined therein, each well having an upper edge and a bottom defining a depth D therebetween, the bottoms of the wells of the first tier being vertically offset from the bottoms of the wells of the second tier by a height; and each well sized and shaped to receive a food item and having an upper edge with an engagement recess formed therein, the engagement recess being sized to allow a food item within the well to be gripped for removal;

wherein the tray is formed of a single sheet of material; and a lid configured to be secured to a feature of the tray.

24. The container of claim 23, wherein the height is approximately one-half the depth D.

* * * * *